US009195214B2

(12) United States Patent
Usui et al.

(10) Patent No.: US 9,195,214 B2
(45) Date of Patent: Nov. 24, 2015

(54) IMAGE FORMING APPARATUS WITH AIR BLOWING PORTION

(71) Applicant: KYOCERA Document Solutions Inc., Osaka-shi, Osaka (JP)

(72) Inventors: Shogo Usui, Osaka (JP); Satoshi Ishii, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/520,092

(22) Filed: Oct. 21, 2014

(65) Prior Publication Data

US 2015/0110519 A1 Apr. 23, 2015

(30) Foreign Application Priority Data

Oct. 23, 2013 (JP) ..... 2013-220627

(51) Int. Cl.
*G03G 21/20* (2006.01)

(52) U.S. Cl.
CPC ..... *G03G 21/206* (2013.01); *G03G 2215/0636* (2013.01)

(58) Field of Classification Search
CPC ..... G03G 21/206
USPC ..... 399/92
See application file for complete search history.

(56) References Cited

FOREIGN PATENT DOCUMENTS

JP 2005283733 A 10/2005
JP 2012255977 A * 12/2012

* cited by examiner

*Primary Examiner* — Quana M Grainger
(74) *Attorney, Agent, or Firm* — Alleman Hall McCoy Russell & Tuttle LLP

(57) ABSTRACT

An image forming apparatus includes a toner containing portion, an air blowing portion, and an air blowing control portion. The toner containing portion contains toner that is used in image formation. The air blowing portion generates an airflow that contacts an outer side surface of the toner containing portion. The air blowing control portion narrows a vertical range of the airflow, which is generated by the air blowing portion and contacts the outer side surface of the toner containing portion, downward in a vertical direction in correspondence with reduction of toner amount in the toner containing portion.

14 Claims, 7 Drawing Sheets

IMAGE FORMING APPARATUS WITH AIR BLOWING PORTION

INCORPORATION BY REFERENCE

This application is based upon and claims the benefit of priority from the corresponding Japanese Patent Application No. 2013-220627 filed on Oct. 23, 2013, the entire contents of which are incorporated herein by reference.

BACKGROUND

The present disclosure relates to an image forming apparatus capable of cooling the toner containing portion containing toner used in image formation.

In general, an image forming apparatus, such as a printer, for forming an image by the electrophotography is provided with a toner containing portion for containing toner used in image formation. The toner contained in such a toner containing portion may be heated by friction between particles of toner in the toner containing portion or by heat that occurs in and transmitted from the fixing unit or the like inside the image forming apparatus. In that case, the toner may be solidified and that may lead to degradation of print quality, or a failure of the image forming apparatus due to toner clogging. On the other hand, as a related technology, there is known a technology in which air is blown to the toner containing portion to cool it, thereby suppressing the temperature rise of the toner in the toner containing portion.

SUMMARY

An image forming apparatus according to an aspect of the present disclosure includes a toner containing portion, an air blowing portion, and an air blowing control portion. The toner containing portion contains toner that is used in image formation. The air blowing portion generates an airflow that contacts an outer side surface of the toner containing portion. The air blowing control portion narrows a vertical range of the airflow, which is generated by the air blowing portion and contacts the outer side surface of the toner containing portion, downward in a vertical direction in correspondence with reduction of toner amount in the toner containing portion.

An image forming apparatus according to another aspect of the present disclosure includes a toner containing portion, an air blowing portion, and an air blowing control portion. The toner containing portion contains toner that is used in image formation. The air blowing portion generates an airflow that contacts an outer side surface of the toner containing portion. The air blowing control portion widens a vertical range of the airflow, which is generated by the air blowing portion and contacts the outer side surface of the toner containing portion, upward in a vertical direction in correspondence with increase of toner amount in the toner containing portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

[First Embodiment]

The following describes an embodiment of the present disclosure with reference to the drawings, for the understanding of the disclosure. It should be noted that the following description is an example of an embodiment of the present disclosure and should not limit the technical scope of the present disclosure.

[Outlined Configuration of Image Forming Apparatus 10]

Figure 1:
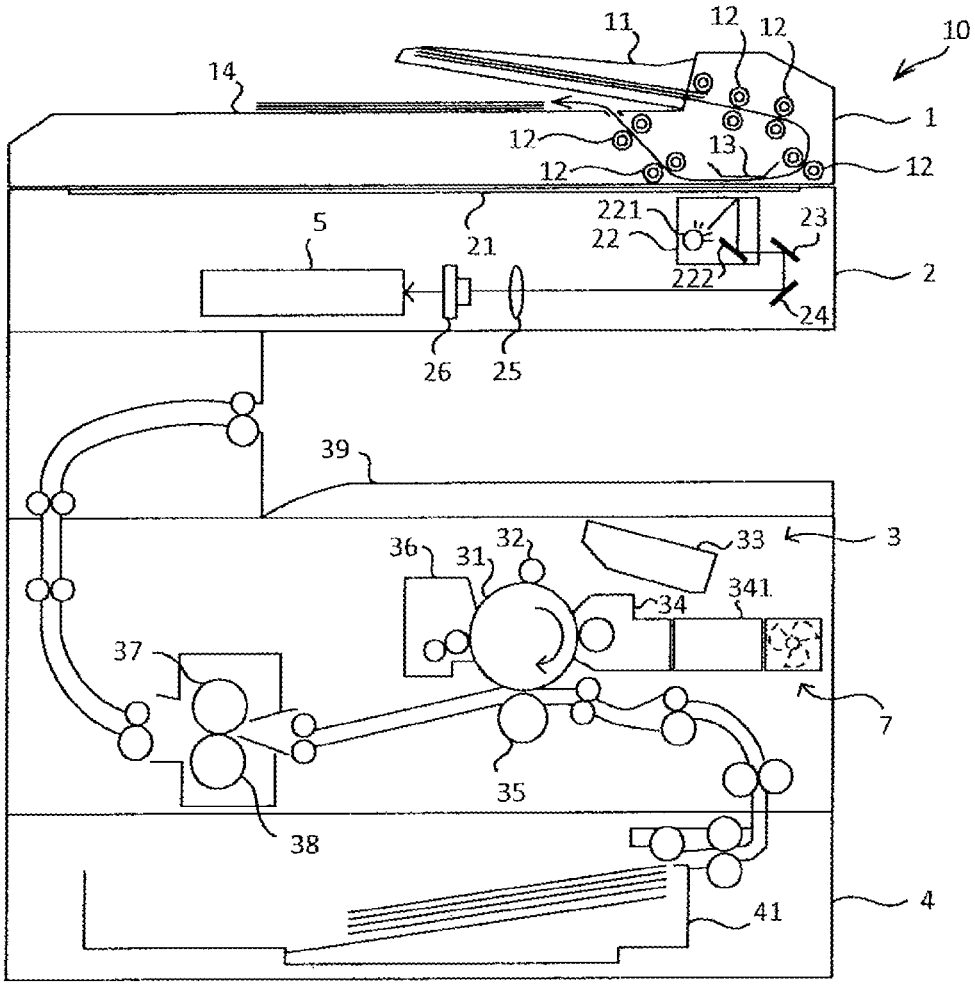
FIG. 1 is an outlined configuration diagram of the image forming apparatus in an embodiment of the present disclosure.
Figure 2:
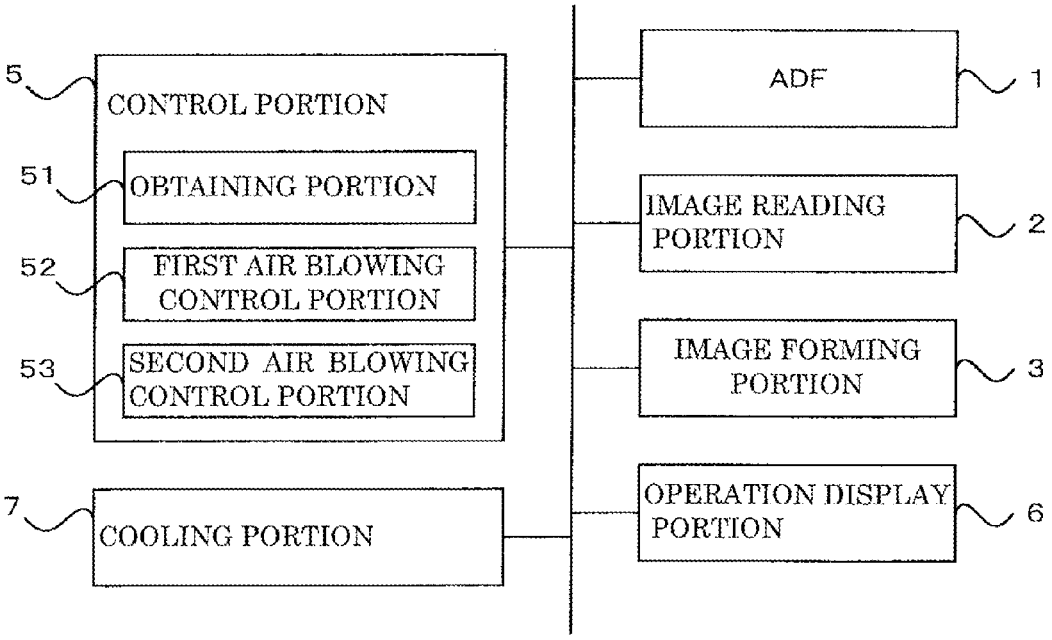
FIG. 2 is a block diagram showing the system configuration of the image forming apparatus in an embodiment of the present disclosure.

First, an outlined configuration of an image forming apparatus 10 in an embodiment of the present disclosure will be described with reference to FIGS. 1 and 2. As shown in FIGS. 1 and 2, the image forming apparatus 10 includes an ADF 1, an image reading portion 2, an image forming portion 3, a sheet feed portion 4, a control portion 5, an operation display portion 6, and a cooling portion 7. The image forming apparatus 10 is a multifunction peripheral having a plurality of functions such as a scan function, a facsimile function, a copy function and the like, as well as a printer function to form an image based on image data. In addition, the present disclosure is applicable to an image forming apparatus such as a printer apparatus, a facsimile apparatus, a copier or the like.

As shown in FIG. 1, the ADF 1 is an automatic document sheet feeding device and includes a document sheet setting portion 11, a plurality of conveying rollers 12, a document sheet pressing 13, and a sheet discharge portion 14. In the ADF 1, the plurality of conveying rollers 12 are driven by motors (not shown) such that a document sheet placed on the document sheet setting portion 11 is conveyed and passes an image data reading position where the image data is read by the image reading portion 2, and then conveyed to the sheet discharge portion 14. With this configuration, the image reading portion 2 can read image data from a document sheet conveyed by the ADF 1.

As shown in FIG. 1, the image reading portion 2 includes a document sheet table 21, a reading unit 22, mirrors 23, 24, an optical lens 25, and a CCD (Charge Coupled Device) 26. The document sheet table 21 is a document sheet placing portion provided on the upper surface of the image reading portion 2. The reading unit 22 includes an LED light source 221 and a mirror 222, and is driven by a motor (not shown) to move in the sub scanning direction (the left-right direction in FIG. 1). The LED light source 221 includes a number of white LEDs arranged along the main scanning direction (the depth direction in FIG. 1). The mirror 222 reflects, toward the mirror 23, light which was irradiated by the LED light source 221 and reflected on the surface of the document sheet at the reading position on the document sheet table 21. The light reflected on the mirror 222 is guided into the optical lens 25 by the mirrors 23, 24. The optical lens 25 condenses incident light and makes the condensed light incident on the CCD 26. The CCD 26 includes a photoelectric converting element or the like, wherein the photoelectric converting element inputs an electric signal, which corresponds to the amount of light incident from the optical lens 25, into the control portion 5 as image data of the document sheet.

The image forming portion 3 is an image forming portion adopting the electrophotography and executes an image forming process (print process) based on the image data which is read by the image reading portion 2 or input from an external information processing apparatus such as a personal computer. Specifically, as shown in FIG. 1, the image forming portion 3 includes a photoconductor drum 31, a charging device 32, an exposure device (LSU) 33, a developing device 34, a transfer roller 35, a cleaning device 36, a fixing roller 37, a pressure roller 38, and a discharge tray 39. In the image forming portion 3, an image is formed in the following procedure on a paper sheet supplied from a sheet feed cassette 41 that is attachable/detachable to/from the sheet feed portion 4, and the paper sheet with the image formed thereon is discharged onto the discharge tray 39.

First, the charging portion 32 charges the surface of the photoconductor drum 31 uniformly into a certain potential. Next, the exposure device 33 irradiates the surface of the photoconductor drum 31 with light based on the image data. With this operation, an electrostatic latent image corresponding to the image data is formed on the surface of the photoconductor drum 31. Then the electrostatic latent image on the photoconductor drum 31 is developed (made visible) as a toner image by the developing device 34. It is noted that the toner (developer) is supplied to the developing device 34 from a toner containing portion 341 that is attachable/detachable to/from the image forming portion 3. Subsequently, the toner image formed on the photoconductor drum 31 is transferred to a paper sheet by the transfer roller 35. The print sheet is then conveyed to pass through between the fixing roller 37 and the pressure roller 38, where the toner image having been transferred to the print sheet is heated by the fixing roller 37 so as to be fused and fixed to the print sheet. It is noted that the toner remaining on the surface of the photoconductor drum 31 is removed by the cleaning device 36.

The control portion 5 includes control equipment such as CPU, ROM, RAM, EEPROM, or the like. The CPU is a processor for executing various types of arithmetic processes. The ROM is a nonvolatile storage portion in which various types of information such as control programs for causing the CPU to execute various types of processes are stored in advance. The RAM is a volatile storage portion, and the EEPROM is a nonvolatile storage portion. The RAM and the EEPROM are used as a temporary storage memory (working area) for the various types of processes executed by the CPU. The control portion 5 comprehensively controls the image processing apparatus 10 by causing the CPU to execute the various types of control programs that have been stored in advance in the ROM. It is noted that the control portion 5 may be formed as an electronic circuit such as an integrated circuit (ASIC). Alternatively, the control portion 5 may be a control portion provided independently of a main control portion that comprehensively controls the image processing apparatus 10.

The operation display portion 6 includes a display portion and an operation portion. The display portion is, for example, a liquid crystal display and displays various types of information based on control instructions from the control portion 5. The operation portion is composed of, for example, hard keys or a touch panel through which various types of information are input to the control portion 5 based on user's operations.

Figure 3:
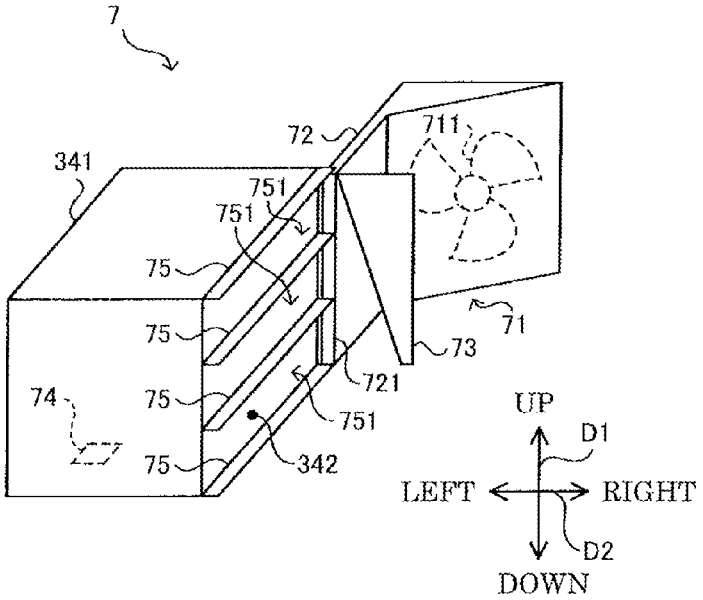
FIG. 3 is a perspective view showing an example of a cooling portion of the image forming apparatus in an embodiment of the present disclosure.

Next, the cooling portion 7 will be described with reference to FIG. 3. The cooling portion 7 is a mechanism for conducting cooling of the toner containing portion 341 of the image forming portion 3 by blowing air thereto. As shown in FIG. 3, the cooling portion 7 includes an air blowing portion 71, a closing member 73, a detection sensor 74, and rib members 75. It is noted that FIG. 3 is a perspective view showing the configuration of the cooling portion 7, and the expressions concerning the up, down, left, and right used in the following description are defined by the up-down direction D1 and the left-right direction D2 provided in FIG. 3.

Here, the toner containing portion 341 contains toner that is used in image formation performed by the image forming portion 3. Specifically, the toner containing portion 341 is a container made of resin and formed in a rectangular parallelepiped shape, and is provided to be attachable/detachable to/from the image forming portion 3. The toner containing portion 341 can supply toner to the developing device 34 from a toner supply port (not shown) provided on an outer side surface thereof located on the left side in FIG. 3.

The air blowing portion 71 can blow air to an outer side surface 342, located on the right side in FIG. 3, of the toner containing portion 341. Specifically, the air blowing portion 71 includes an air blowing fan 711 and a duct 72. Here, the air blowing portion 71 is an example of the air blowing portion of the present disclosure.

The air blowing fan 711 can generate an airflow that contacts the outer side surface 342 of the toner containing portion 341. Specifically, the air blowing fan 711 is provided on an outer surface of the image forming apparatus 10, intakes air from outside of the image forming apparatus 10, and sends the intake air into the duct 72.

The duct 72 guides the airflow generated by the air blowing fan 711, to the outer side surface 342 of the toner containing portion 341. Specifically, the duct 72 includes an air inlet (not shown) and an air outlet 721 that is opened toward the outer side surface 342.

The closing member 73 can, with its movement in a predetermined direction, gradually close the air outlet 721 of the duct 72 from the vertical up direction to the vertical down direction. Specifically, the closing member 73 is a plate-like member having a plane surface vertical to the air blowing direction of the air blowing from the air outlet 721. The closing member 73 gradually closes the air outlet 721 from the vertical up direction to the vertical down direction by being moved in a direction parallel to the plane surface of the closing member 73 by a driving mechanism (not shown). It is noted that the driving mechanism is, for example, a driving mechanism that converts a rotary movement of a pinion gear generated by a motor to a linear movement of a rack, thereby moving the closing member 73 that has been fixed to the rack.

More specifically, as shown in FIG. 3, the closing member 73 is a plate-like member in the shape of a reverse trapezoid, and is set with its position at the right side of the air outlet 721 as the home position thereof. As shown in FIG. 3, with its leftward movement in FIG. 3, the closing member 73 gradually closes the air outlet 721 from the vertical up direction to the vertical down direction. Here, the leftward direction in FIG. 3 is an example of the predetermined direction that is defined in advance as the movement direction of the closing member 73 for gradually closing the opening area of the air outlet 721.

It is noted that, as another embodiment, the closing member 73 may be a rectangular plate-like member that is set with its position at the upper side of the air outlet 721 in the vertical direction as the home position thereof. In that case, the closing member 73 is moved downward in the vertical direction by the driving mechanism, thereby gradually closing the air outlet 721 from the vertical up direction to the vertical down direction. In that case, the downward direction in the vertical direction is an example of the predetermined direction.

The detection sensor 74 is a sensor for detecting the amount of toner contained in the toner containing portion 341. Specifically, the detection sensor 74 is a pressure sensor provided on the inner bottom surface of the toner containing portion 341, and outputs to the control portion 5 an electric signal that corresponds to the amount (weight) of toner contained in the toner containing portion 341. It is noted that, as another embodiment, the image forming apparatus 10 may include an optical sensor as the detection sensor 74. For example, it is possible to detect the toner amount in the toner containing portion 341 from detection results of a plurality of optical sensors, which each determine whether or not toner exists in a plurality of translucent windows formed on the toner containing portion 341.

The rib members 75 are provided on the outer side surface 342 of the toner containing portion 341, and guide the airflow, which is generated by the air blowing portion 71 and discharged from the duct 72, in the horizontal direction along the outer side surface 342. Specifically, as shown in FIG. 3, a plurality of passages 751 are formed between the rib members 75, wherein the passages 751 extend in the horizontal direction along the outer side surface 342 of the toner containing portion 341. With this configuration, the airflow discharged from the duct 72 is guided through the passages 751 formed between the rib members 75, in the horizontal direction along the outer side surface 342. As a result, the diffusion of the airflow discharged from the duct 72 is suppressed and the cooling effect by the airflow of cooling the outer side surface 342 of the toner containing portion 341 is enhanced. It is noted that the number of the rib members 75 may be determined as appropriate.

As described above, in the image forming apparatus 10, the toner contained in the toner containing portion 341 can be cooled by the cooling portion 7. Meanwhile, according to the above-mentioned related technology, air is blown by the cooling portion 7 always to the whole side surface of the toner containing portion 341, namely the range of the air blowing by the cooling portion 7 to the toner containing portion 341 is the whole side surface of the toner containing portion 341. As a result, when the toner amount in the toner containing portion 341 decreases, air is blown even to parts where no toner exists. On the other hand, according to the image forming apparatus 10 of the present disclosure, when the toner amount in the toner containing portion 341 decreases, the range of the air blowing to the side surface of the toner containing portion 341 is restricted, and the air is blown only to parts where toner exists. As a result, according to the image forming apparatus 10 of the present disclosure, the efficiency of cooling the toner containing portion 341 by air blowing is improved.

Specifically, as shown in FIG. 2, the control portion 5 includes an obtaining portion 51, a first air blowing control portion 52, and a second air blowing control portion 53. It is noted that the control portion 5 functions as the obtaining portion 51, first air blowing control portion 52, and second air blowing control portion 53 as the CPU executes air blowing control programs stored in the ROM. When the control portion 5 is an electronic circuit, the obtaining portion 51, first air blowing control portion 52, and second air blowing control portion 53 are configured as respective modules provided in the control portion 5. Here, the first air blowing control portion 52 is an example of the air blowing control portion of the present disclosure.

The obtaining portion 51 obtains the toner amount in the toner containing portion 341. Specifically, the obtaining portion 51 obtains the toner amount in the toner containing portion 341 based on the electric signal output from the detection sensor 74. It is noted that the method by which the obtaining portion 51 obtains the amount of toner is not limited to the use of the electric signal output from the detection sensor 74. For example, the obtaining portion 51 may obtain a current amount of toner by counting the number of printing performed by the image forming portion 3 starting from the state where the toner containing portion 341 is full of toner, and calculating a prediction value of the amount of consumed toner from the counted number of printing.

The first air blowing control portion 52 executes a process of narrowing the vertical range of the airflow, which is generated by the air blowing portion 71 and contacts the outer side surface 342 of the toner containing portion 341, downward in the vertical direction in correspondence with reduction of toner amount in the toner containing portion 341. Specifically, the first air blowing control portion 52 narrows the vertical range of the airflow, which is discharged from the duct 72 and contacts the outer side surface 342 of the toner containing portion 341, downward in the vertical direction in correspondence with the obtainment result of the obtaining portion 51. More specifically, the first air blowing control portion 52 moves the closing member 73 in the predetermined direction in correspondence with the obtainment result of the obtaining portion 51 such that the air outlet 721 of the duct 72 is gradually closed from the vertical up direction to the vertical down direction. For example, when the closing member 73 is disposed as shown in FIG. 3, the first air blowing control portion 52 controls the driving mechanism to move the closing member 73 to a position corresponding to the current amount of toner on a movable path in the left-right direction shown in FIG. 3 in correspondence with the obtainment result of the obtaining portion 51, with the reference position being the home position.

The second air blowing control portion 53 can restrict either one or both of the air blowing amount and the air blowing time of the air blowing fan 711 in correspondence with the obtainment result of the obtaining portion 51. Specifically, in the image forming apparatus 10, the second air blowing control portion 53 calculates the toner reduction amount from the obtainment result of the obtaining portion 51, and reduces the power supply to the air blowing fan 711 in correspondence with the calculated toner reduction amount, thereby restricting the air blowing amount of the air blowing fan 711. It is noted that the second air blowing control portion 53 may reduce the power supply time of the power supply to the air blowing fan 711 in correspondence with the toner reduction amount, thereby restricting the air blowing time of the air blowing fan 711. Furthermore, the second air blowing control portion 53 may reduce the power supply and the power supply time of the power supply to the air blowing fan 711 in correspondence with the toner reduction amount, thereby restricting both the air blowing amount and air blowing time of the air blowing fan 711.

[Air Blowing Control Process]

Figure 4:
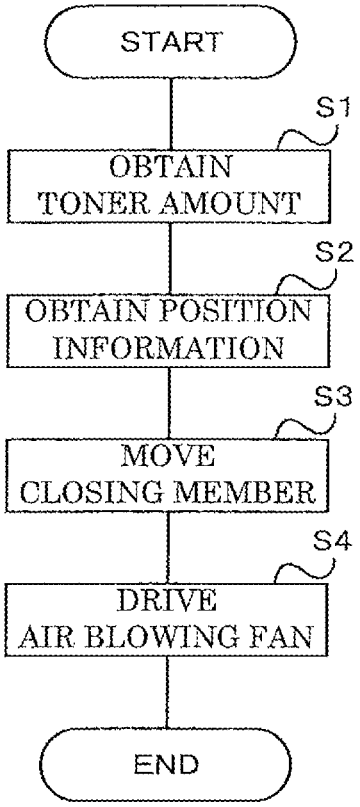
FIG. 4 is a flowchart showing an example of the air blowing control process executed by the image forming apparatus in an embodiment of the present disclosure.

The following describes an example of the procedure of the air blowing control process executed by the control portion 5 in the image forming apparatus 10, with reference to FIG. 4. Here, steps S1, S2, . . . represent the processing procedures (steps) executed by the control portion 5. It is noted that the control portion 5 executes the air blowing control process when the image forming portion 3 executes the image forming process.

<Step S1>

First, in step S1, the obtaining portion 51 obtains the toner amount in the toner containing portion 341, based on the electric signal output from the detection sensor 74.

<Step S2>

In step S2, based on the obtainment result in step S1, the first air blowing control portion 52 obtains information indicating a position on the movable path in which the closing member 73 can be moved. For example, the first air blowing control portion 52 obtains the information indicating a position on the movable path corresponding to the obtained toner amount, by referring to the table data that indicates the correspondence between toner amounts and positions on the movable path, the table data having been stored in the EEPROM or the like in advance.

<Step S3>

In step S3, the first air blowing control portion 52 controls the driving mechanism to cause the closing member 73 to move to a position on the movable path that corresponds to the information obtained in step S2 indicating the position on the movable path. This allows for the vertical range of the airflow, which contacts the outer side surface 342 of the toner containing portion 341, to be narrowed downward in the vertical direction in correspondence with the toner amount in the toner containing portion 341.

Figure 5A:
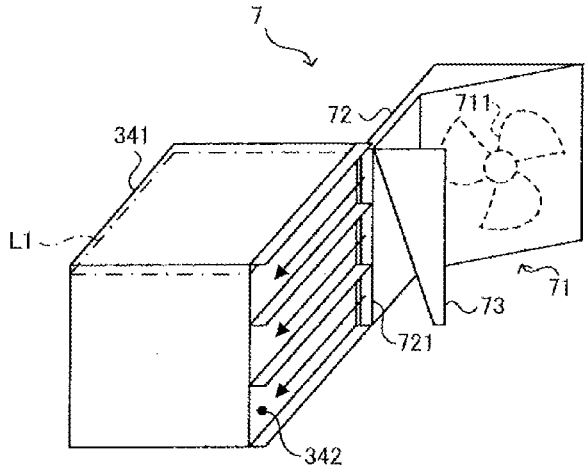
FIGS. 5A, 5B and 5C are diagrams showing an example of the operation of a first air blowing control portion of the image forming apparatus in an embodiment of the present disclosure.
Figure 5B:
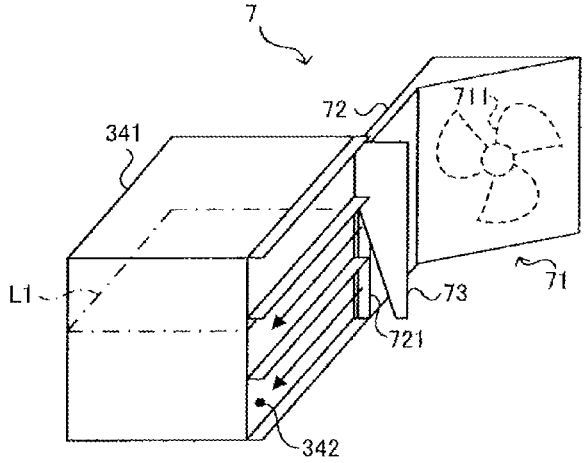
Figure 5C:
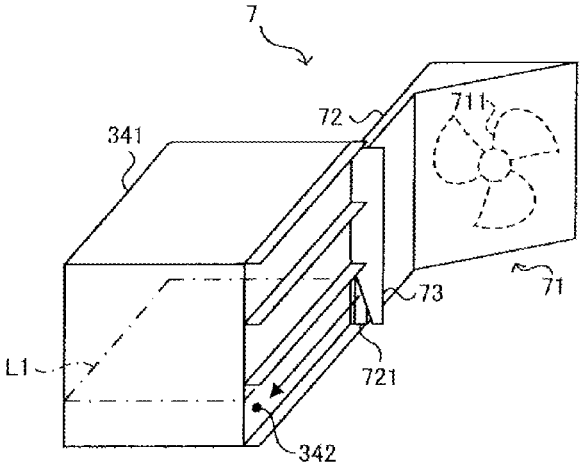

Here, an explanation is given of an example of the movement control performed by the first air blowing control portion 52 on the closing member 73 in correspondence with the toner amount, with reference to FIGS. 5A, 5B and 5C. It is noted that FIGS. 5A, 5B and 5C are, like FIG. 3, perspective views of the cooling portion 7, and the arrows in the drawing indicate the direction of the airflow discharged from the air outlet 721. It is also noted that a single dashed chain line L1 shown in FIGS. 5A, 5B and 5C indicates the height in the vertical direction of the surface of the toner contained in the toner containing portion 341.

First, a movement control in the case of FIG. 5A where the toner containing portion 341 is almost full of toner is explained. In this case, the first air blowing control portion 52 moves the closing member 73 to a position on the movable path where the closing member 73 does not close the air outlet 721. In this state, the vertical range of the airflow that contacts the outer side surface 342 of the toner containing portion 341 is not restricted, and the air blowing from the air blowing fan 711 passes the whole outer side surface 342 of the toner containing portion 341.

Next, a movement control in the case of FIG. 5B where the toner fills approximately half of the toner containing portion 341 is explained. In this case, the first air blowing control portion 52 moves the closing member 73 to a position on the movable path where the closing member 73 closes approximately half range of the air outlet 721. In this state, the vertical range of the airflow that contacts the outer side surface 342 of the toner containing portion 341 is narrowed to the height of the surface of the toner contained in the toner containing portion 341.

Lastly, a movement control in the case of FIG. 5C where the toner fills approximately a fourth of the toner containing portion 341 is explained. In this case, the first air blowing control portion 52 moves the closing member 73 to a position on the movable path where the closing member 73 closes approximately three fourths of the air outlet 721. In this state, as is the case with FIG. 5B, the vertical range of the airflow that contacts the outer side surface 342 of the toner containing portion 341 is narrowed to the height of the surface of the toner contained in the toner containing portion 341.

As described above, the first air blowing control portion 52 narrows the vertical range of the airflow that contacts the outer side surface 342 of the toner containing portion 341 to the height of the surface of the toner contained in the toner containing portion 341, in correspondence with the toner amount in the toner containing portion 341. This restricts the airflow generated by the air blowing fan 711 from passing through an area in the outer side surface 342 of the toner containing portion 341 where the toner does not contact the inner surface thereof.

<Step S4>

In step S4, the second air blowing control portion 53 sets an amount of power to be supplied to the air blowing fan 711, based on the obtainment result in step S1, and drives the air blowing fan 711 by controlling a power source (not shown) such that the set amount of power is supplied to the air blowing fan 711. Specifically, the second air blowing control portion 53 restricts the air blowing amount of the air blowing fan 711 by calculating the toner reduction amount from the obtainment result of the obtaining portion 51, and reducing the power supply to the air blowing fan 711 in correspondence with the calculated toner reduction amount.

It is noted that when the printing is performed continuously in the image forming process, the heating amount of the toner in the toner containing portion 341 increases accordingly. As a result, the second air blowing control portion 53 sets the time period for which to drive the air blowing fan 711, in correspondence with the number of printing performed in the image forming process, and drives the air blowing fan 711 for the set time period. After completing the driving of the air blowing fan, the second air blowing control portion 53 ends the air blowing control process.

As described above, according to the image forming apparatus 10, the vertical range of the airflow, which is generated by the air blowing fan 711 and contacts the outer side surface 342 of the toner containing portion 341, is narrowed to the height of the surface of the toner contained in the toner containing portion 341, in correspondence with reduction of toner amount in the toner containing portion 341. As a result, according to the image forming apparatus 10, when the toner amount in the toner containing portion 341 decreases, air is blown only to parts of the toner containing portion 341 where toner exists, thereby improving the efficiency of cooling the toner containing portion 341 by blowing air thereto.

In addition, according to the image forming apparatus 10, the air blowing amount of the air blowing fan 711 is restricted in correspondence with the restriction of the vertical range of the airflow that contacts the outer side surface 342 of the toner containing portion 341. As a result, according to the image forming apparatus 10, when the toner amount in the toner containing portion 341 decreases, the effect of cooling the toner containing portion 341 is maintained and the power consumption by the air blowing fan 711 is restricted. It is noted that this also applies to the case where the air blowing time of the air blowing fan 711 is restricted, and to the case where both the air blowing amount and the air blowing time are restricted.

Furthermore, according to the image forming apparatus 10, with the presence of the rib members 75 provided in the toner containing portion 341, the airflow generated by the air blowing fan 711 is guided in the horizontal direction along the outer side surface 342 of the toner containing portion 341. As a result, the efficiency of cooling the toner containing portion 341 is more improved when the vertical range of the airflow, which contacts the outer side surface 342 of the toner containing portion 341, is restricted.

It is noted that in the case where the rib members 75 are provided in the image forming apparatus 10, the air blowing fan 711 may suck the air from the toner containing portion 341 and discharge the air to outside the image forming apparatus 10. That is, when the rib members 75 are provided, even when the air blowing fan 711 sucks the air from the toner containing portion 341, the rib members 75 guide the airflow in the horizontal direction along the outer side surface 342 of the toner containing portion 341. This produces the same cooling effect as in the case where the air blowing fan 711 blows air.

[Other Embodiments]

The following describes the image forming apparatus 10 in the second through fifth embodiments of the present disclosure with reference to the FIGS. 6, 7, 8, 9A and 9B. The image forming apparatus 10 in the following embodiments is different from the image forming apparatus 10 of the first embodiment in configuration of the control portion 5 and the cooling portion 7. As a result, in the following embodiments, only differences from the image forming apparatus 10 of the first embodiment are explained. In addition, FIGS. 6, 7, 8, 9A and 9B are perspective views of the cooling portion 7, and the expressions concerning the up, down, left, and right used in the following description are defined by the up-down direction D1 and the left-right direction D2 as in FIG. 3.

[Second Embodiment]

Figure 6:
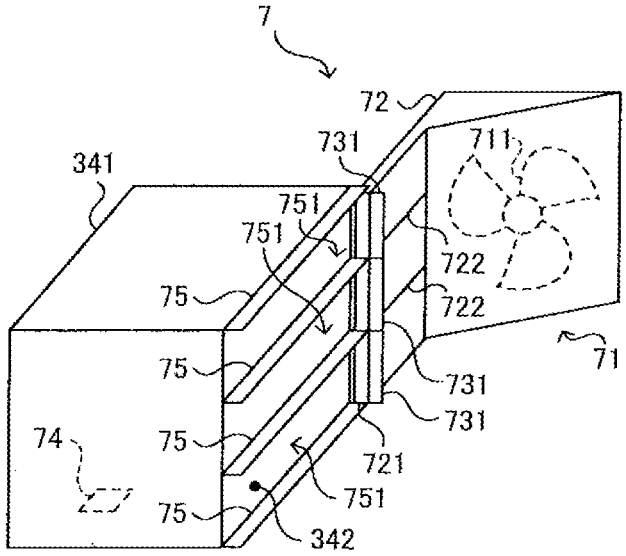
FIG. 6 is a perspective view showing another example of a cooling portion of the image forming apparatus in an embodiment of the present disclosure.

As shown in FIG. 6, the cooling portion 7 of the second embodiment differs from the first embodiment in the configuration of the duct 72 and the closing member 73. Specifically, the duct 72 includes partitioning portions 722 and closing members 731. The partitioning portions 722 partition the air outlet 721, from which the airflow is discharged toward the toner containing portion 341, into a plurality of areas in the vertical direction. The closing members 731 can close the areas individually. The closing members 731 are each a plate-like member having a plane surface vertical to the air blowing direction of the air blown from the air outlet 721. The closing members 731 can close the areas individually by being moved by driving mechanisms (not shown) in a direction parallel to the plane surface of the closing members 731. For example, as shown in FIG. 6, the closing members 731 are provided on the right side of the air outlet 721 in correspondence with the areas, respectively. The closing members 731 are moved leftward in FIG. 6 by a plurality of driving mechanisms provided in correspondence with the closing members 731 respectively such that the areas of the air outlet 721 are individually closed.

In addition, the first air blowing control portion 52 of the control portion 5 in the second embodiment controls the closing members 731 to close the areas in sequence from the vertical up direction to the vertical down direction, in correspondence with the obtainment result of the obtaining portion 51. For example, the first air blowing control portion 52 closes the areas in sequence by controlling the driving mechanisms to move the closing members 731.

As described above, in the second embodiment, the image forming apparatus 10 closes the areas of the air outlet 721 in sequence from the vertical up direction to the vertical down direction, and thereby narrows, downward in the vertical direction, the vertical range of the airflow, which is generated by the air blowing fan 711 and contacts the outer side surface 342 of the toner containing portion 341, in correspondence with reduction of toner amount in the toner containing portion 341. With this configuration, the wind pressure applied to the closing member that closes the air outlet 721 of the duct 72 is dispersed. This makes it possible to restrict occurrence of a mulfunction such as a failure of the closing member and the movement mechanism thereof.

[Third Embodiment]

Figure 7:
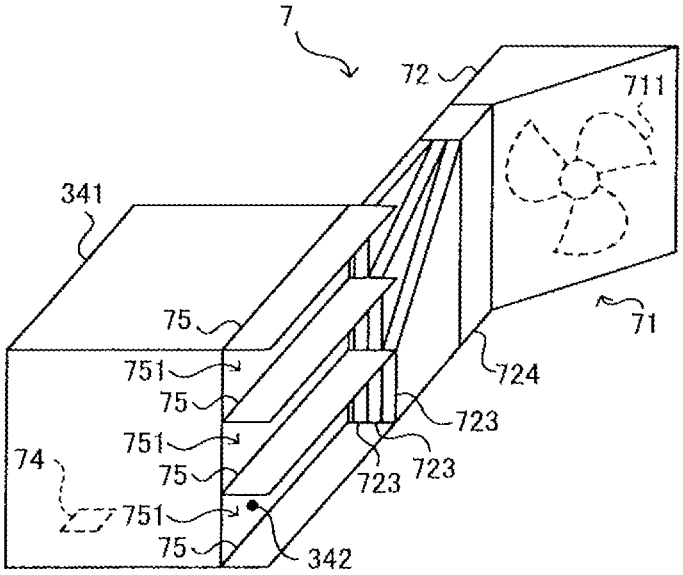
FIG. 7 is a perspective view showing a still another example of a cooling portion of the image forming apparatus in an embodiment of the present disclosure.

As shown in FIG. 7, the cooling portion 7 of the third embodiment does not include the closing member 73, and differs from the first embodiment in the configuration of the duct 72. Specifically, the duct 72 includes a plurality of air outlets 723 and a switch 724. The plurality of air outlets 723 differ from each other in the vertical range of the airflow, which is discharged toward the toner containing portion 341. The switch 724 can switch between opening and closing of each of the air outlets 723. For example, the switch 724 may be provided inside the duct 72 and use a driving mechanism (not shown) to cause a switching valve to switch between opening and closing of the internal passages of the duct 72 that respectively communicate with the air outlets 723.

In addition, in the third embodiment, the first air blowing control portion 52 of the control portion 5 causes the switch 724 to open the air outlets 723 in an order where the vertical range of the air outlets 723 is narrowed downward in the vertical direction in correspondence with the obtainment result of the obtaining portion 51. For example, the first air blowing control portion 52 may open the air outlets 723 by controlling the driving mechanism to cause the switching valve to switch between opening and closing of the internal passages of the duct 72 that respectively communicate with the air outlets 723.

As described above, according to the image forming apparatus 10 of the third embodiment, the switch 724 opens the air outlets 723 in an order where the vertical range of the air outlets 723 is narrowed downward in the vertical direction, thereby the vertical range of the airflow, which is generated by the air blowing fan 711 and contacts the outer side surface 342 of the toner containing portion 341, is narrowed downward in the vertical direction in correspondence with reduction of toner amount in the toner containing portion 341. With this configuration, it is possible to reduce the influence of the wind pressure, compared with the case where the closing member for closing the air outlet 721 of the duct 72 is provided.

[Fourth Embodiment]

Figure 8:
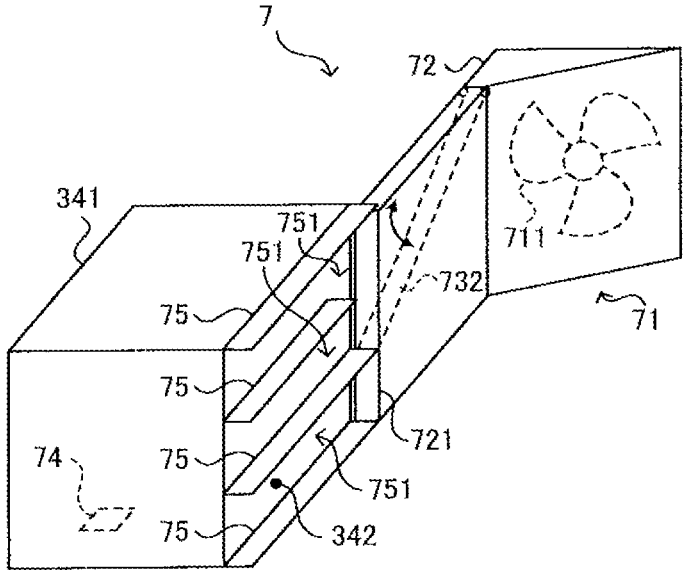
FIG. 8 is a perspective view showing a further example of a cooling portion of the image forming apparatus in an embodiment of the present disclosure.

As shown in FIG. 8, the cooling portion 7 of the fourth embodiment differs from the first embodiment in the configuration of the duct 72 and the closing member 73. Specifically, inside the duct 72, a closing member 732 gradually closes the air outlet 721 of the duct 72 from the vertical up direction to the vertical down direction. For example, the closing member 732 may be pivotally supported by a rotational shaft provided on the upstream side of the duct 72, and pivoted by a driving mechanism (not shown) in a direction from the vertical up direction to the vertical down direction, thereby gradually closing the air outlet 721 from the vertical up direction to the vertical down direction. In this case, the direction from the vertical up direction to the vertical down direction is an example of the predetermined direction.

In addition, in the fourth embodiment, the first air blowing control portion 52 of the control portion 5 moves the closing member 732 in the predetermined direction in correspondence with the obtainment result of the obtaining portion 51, thereby gradually closing the air outlet 721 of the duct 72 from the vertical up direction to the vertical down direction. For example, the first air blowing control portion 52 may close the air outlet 721 by controlling the driving mechanism to cause the closing member 732 to pivot around the rotational shaft from the vertical up direction to the vertical down direction.

As described above, according to the fourth embodiment, the image forming apparatus 10 gradually closes the air outlet 721 of the duct 72 from the vertical up direction to the vertical down direction by moving the closing member 732 in the predetermined direction, thereby the vertical range of the airflow, which is generated by the air blowing fan 711 and contacts the outer side surface 342 of the toner containing portion 341, is narrowed downward in the vertical direction in correspondence with reduction of toner amount in the toner containing portion 341. With this configuration, it is possible to reduce the influence of the wind pressure, compared with the case of closing the air outlet 721 of the duct 72.

[Fifth Embodiment]

Figure 9A:
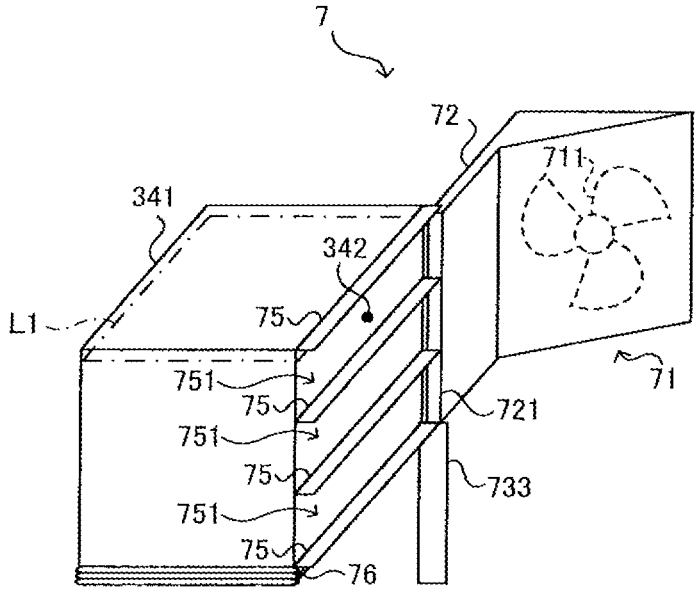
FIGS. 9A and 9B are perspective views showing a still further example of a cooling portion of the image forming apparatus in an embodiment of the present disclosure.
Figure 9B:
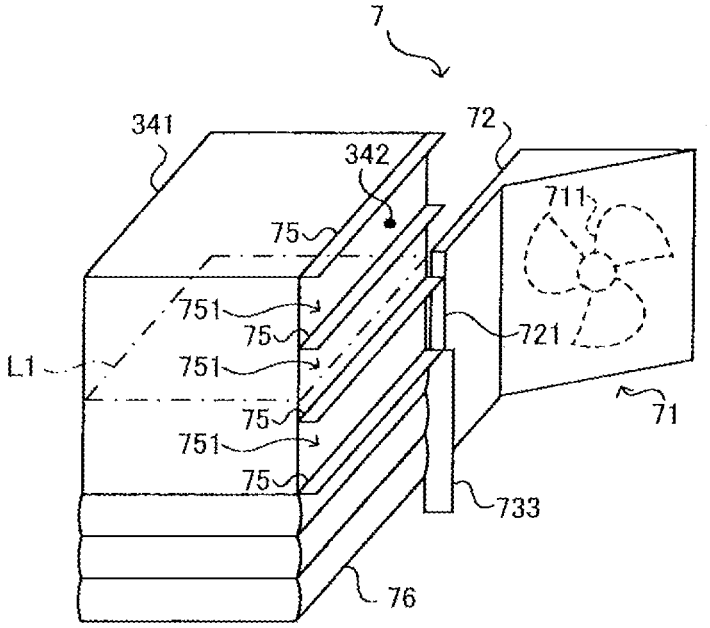

As shown in FIGS. 9A and 9B, the cooling portion 7 of the image forming apparatus 10 in the fifth embodiment does not include the detection sensor 74, and differs from the first embodiment in the closing member 73. In addition, according to the image forming apparatus 10 in the fifth embodiment, a component corresponding to the air blowing control portion is included in the cooling portion 7, not in the control portion 5. Specifically, the cooling portion 7 includes a moving portion 76 and a closing member 733. The moving portion 76 moves the toner containing portion 341 upward in the vertical direction in correspondence with the toner amount in the toner containing portion 341. The closing member 733 gradually closes the air outlet 721 of the duct 72 from the vertical down direction to the vertical up direction in correspondence with the movement of the toner containing portion 341 by the moving portion 76. For example, the closing member 733 may be a rectangular plate-like member that is provided at a lower end of the outer side surface 342 of the toner containing portion 341, has a plane surface that is vertical to the air blowing direction of the air blowing from the air outlet 721, and extends downward in the vertical direction from the lower end of the outer side surface 342. The moving portion 76 may be a spring-like member that can be expanded and contracted in correspondence with the amount (weight) of toner contained in the toner containing portion 341. Here the moving portion 76 is an example of the containing portion moving portion of the present disclosure.

As described above, according to the fifth embodiment, the image forming apparatus 10 moves the toner containing portion 341 upward in the vertical direction and causes the closing member 733 to gradually close the air outlet 721 of the duct 72 from the vertical down direction to the vertical up direction, thereby narrowing the vertical range of the airflow, which is generated by the air blowing fan 711 and contacts the outer side surface 342 of the toner containing portion 341, downward in the vertical direction in correspondence with reduction of toner amount in the toner containing portion 341. With this configuration, it is possible to implement the present disclosure with a simple configuration.

[Sixth embodiment]

Meanwhile, in each of the above-described embodiments, the toner containing portion 341 that contains toner used in the image forming apparatus 10 is described as an example of the toner containing portion of the present disclosure.

On the other hand, for example, a toner recovery tank can be considered as another example of the toner containing portion of the present disclosure, wherein the toner recovery tank stores waste toner that, among the toner used in an image formation, is discharged after the image formation is performed. The following describes an embodiment in the case where the toner containing portion 341 is such a toner recovery tank. Specifically, the first air blowing control portion 52 widens the vertical range of the airflow, which is generated by the air blowing portion 71 and contacts the outer side surface of the toner containing portion 341, upward in the vertical direction in correspondence with the increase of the toner amount in the toner containing portion 341.

In the case of the first embodiment, the first air blowing control portion 52 may widen the vertical range of the airflow, which is discharged from the duct 72 and contacts the outer side surface of the toner containing portion 341, upward in the vertical direction in correspondence with the obtainment result of the obtaining portion 51. In particular, the first air blowing control portion 52 may gradually open the air outlet of the duct 72 from the vertical down direction to the vertical up direction by moving the closing member 73 in the predetermined direction in correspondence with the obtainment result of the obtaining portion 51. That is, the movement direction of the closing member 73 is an opposite direction to the direction described in the first embodiment. In addition, in the image forming apparatus 10, the second air blowing control portion 53 may calculate the toner increase amount from the obtainment result of the obtaining portion 51, and increase the power supply to the air blowing fan 711 in correspondence with the calculated toner increase amount, thereby increasing the air blowing amount of the air blowing fan 711.

In the case of the second embodiment, the duct 72 includes the partitioning portions 722 and the closing members 731. The partitioning portions 722 partition the air outlet 721, from which the airflow is discharged toward the toner containing portion 341, into a plurality of areas in the vertical direction. The closing members 731 can close the areas individually. In this case, the first air blowing control portion 52 may control the closing members 731 to open the areas in sequence from the vertical down direction to the vertical up direction, in correspondence with the obtainment result of the obtaining portion 51.

In the case of the third embodiment, the duct 72 includes the plurality of air outlets 723 and the switch 724. The plurality of air outlets 723 differ from each other in the vertical range of the airflow, which is discharged toward the toner containing portion 341. The switch 724 can switch between opening and closing of each of the air outlets 723. In this case, the first air blowing control portion 52 may control the switch 724 to open the air outlets 723 in an order where the vertical range of the air outlets 723 is widened upward in the vertical direction, in correspondence with the obtainment result of the obtaining portion 51.

In the case of the fourth embodiment, the first air blowing control portion 52 may move the closing member 732 in the predetermined direction in correspondence with the obtainment result of the obtaining portion 51, thereby gradually opening the air outlet 721 of the duct 72 from the vertical down direction to the vertical up direction.

In the case of the fifth embodiment, the moving portion 76 may move the toner containing portion 341 downward in the vertical direction in correspondence with the toner amount increase in the toner containing portion 341, and the closing member 733 may gradually open the air outlet 721 of the duct 72 from the vertical down direction to the vertical up direction. As a result, the vertical range of the airflow, which is generated by the air blowing fan 711 and contacts the outer side surface 342 of the toner containing portion 341, is widened upward in the vertical direction in correspondence with the toner amount increase in the toner containing portion 341.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a toner containing portion containing toner that is used in image formation;

an obtaining portion configured to obtain a toner amount in the toner containing portion;

an air blowing portion including an air blowing fan and a duct that guides an airflow generated by the air blowing fan, such that the airflow contacts an outer side surface of the toner containing portion; and an air blowing control portion configured to narrow a vertical range of the airflow by gradually closing an air outlet of the duct from an upper end of the air outlet to a lower end of the air outlet by moving a closing member in a predetermined direction in correspondence with an obtainment result of the obtaining portion which indicates a reduction of toner amount in the toner containing portion.

2. The image forming apparatus according to claim 1, wherein inside the duct, the closing member gradually closes the air outlet of the duct from the upper end of the air outlet to the lower end of the air outlet.

3. An image forming apparatus comprising:

a toner containing portion containing toner that is used in image formation;

an obtaining portion configured to obtain a toner amount in the toner containing portion;

an air blowing portion including an air blowing fan and a duct that guides an airflow generated by the air blowing fan, such that the airflow contacts an outer side surface of the toner containing portion, wherein the duct includes a partitioning portion and a closing member, the partitioning portion partitioning an air outlet, from which the airflow is discharged toward the toner containing portion, into a plurality of areas in the vertical direction, the closing member being configured to close the areas individually; and an air blowing control portion configured to narrow a vertical range of the airflow by closing the areas in sequence from an upper end of the air outlet to a lower end of the air outlet by using the closing member in correspondence with the obtainment result of the obtaining portion which indicates a reduction of toner amount in the toner containing portion.

4. The image forming apparatus according to claim 1, wherein the air blowing control portion is a first air blowing control portion, and the image forming apparatus further comprises a second air blowing control portion configured to restrict either one or both of an air blowing amount and an air blowing time of the air blowing fan in correspondence with the obtainment result of the obtaining portion.

5. The image forming apparatus according to claim 1, wherein the toner containing portion includes a rib member configured to guide the airflow, which is generated by the air blowing portion, in a horizontal direction along the outer side surface of the toner containing portion.

6. An image forming apparatus comprising:

a toner containing portion containing toner that is used in image formation;

an obtaining portion configured to obtain a toner amount in the toner containing portion;

an air blowing portion including an air blowing fan and a duct that guides an airflow generated by the air blowing fan, such that the airflow contacts an outer side surface of the toner containing portion; and an air blowing control portion configured to widen a vertical range of the airflow by gradually opening an air outlet of the duct from a lower end of the air outlet to an upper end of the air outlet by moving a closing member in a predetermined direction in correspondence with an obtainment result of the obtaining portion which indicates an increase of toner amount in the toner containing portion.

7. The image forming apparatus according to claim 6, wherein inside the duct, the closing member gradually opens the air outlet of the duct from the lower end of the air outlet to the upper end of the air outlet.

8. An image forming apparatus comprising:

a toner containing portion containing toner that is used in image formation;

an obtaining portion configured to obtain a toner amount in the toner containing portion;

an air blowing portion including an air blowing fan and a duct that guides an airflow generated by the air blowing fan, such that the airflow contacts an outer side surface of the toner containing portion, wherein the duct includes a partitioning portion and a closing member, the partitioning portion partitioning an air outlet, from which the airflow is discharged toward the toner containing portion, into a plurality of areas in the vertical direction, the closing member being configured to close the areas individually; and an air blowing control portion configured to widen a vertical range of the airflow by opening the areas in sequence from a lower end of the air outlet to an upper end of the air outlet by moving the closing member in correspondence with the obtainment result of the obtaining portion which indicates an increase of toner amount in the toner containing portion.

9. The image forming apparatus according to claim 6, wherein the air blowing control portion is a first air blowing control portion, and the image forming apparatus further comprises a second air blowing control portion configured to restrict either one or both of an air blowing amount and an air blowing time of the air blowing fan in correspondence with the obtainment result of the obtaining portion.

10. The image forming apparatus according to claim 6, wherein the toner containing portion includes a rib member configured to guide the airflow, which is generated by the air blowing portion, in a horizontal direction along the outer side surface of the toner containing portion.

11. The image forming apparatus according to claim 3, wherein the air blowing control portion is a first air blowing control portion, and the image forming apparatus further comprises a second air blowing control portion configured to restrict either one or both of an air blowing amount and an air blowing time of the air blowing fan in correspondence with the obtainment result of the obtaining portion.

12. The image forming apparatus according to claim 3, wherein the toner containing portion includes a rib member configured to guide the airflow, which is generated by the air blowing portion, in a horizontal direction along the outer side surface of the toner containing portion.

13. The image forming apparatus according to claim 8, wherein the air blowing control portion is a first air blowing control portion, and the image forming apparatus further comprises a second air blowing control portion configured to restrict either one or both of an air blowing amount and an air blowing time of the air blowing fan in correspondence with the obtainment result of the obtaining portion.

14. The image forming apparatus according to claim 8, wherein the toner containing portion includes a rib member configured to guide the airflow, which is generated by the air blowing portion, in a horizontal direction along the outer side surface of the toner containing portion.

* * * * *